US005113228A

United States Patent [19]

Monma et al.

[11] Patent Number: 5,113,228

[45] Date of Patent: May 12, 1992

[54] SHEET SEPARATING MECHANISM

[75] Inventors: Yoshio Monma, Oodi; Hiroyuki Yamaguchi, Tokyo, both of Japan

[73] Assignee: Asahi Kogaku Kogyo Kabushiki Kaisha, Tokyo, Japan

[21] Appl. No.: 652,608

[22] Filed: Feb. 8, 1991

[30] Foreign Application Priority Data

Feb. 9, 1990 [JP] Japan ..... 2-30682

[51] Int. Cl.[5] ..... G03G 15/00

[52] U.S. Cl. ..... 355/315; 355/311

[58] Field of Search ..... 355/200, 271, 274, 309, 355/311, 315

[56] References Cited

U.S. PATENT DOCUMENTS 4,392,738 7/1983 Fujino et al. ..... 355/271
4,929,982 5/1990 Ainoya et al. ..... 355/274 X
4,963,941 10/1990 Negishi et al. ..... 355/271 X

FOREIGN PATENT DOCUMENTS 2-103076 4/1990 Japan .

*Primary Examiner*—Joan H. Pendegrass

*Attorney, Agent, or Firm*—Sandler, Greenblum, & Bernstein

[57] ABSTRACT

In an electrophotographic printer using a continuous-form sheet on which a visible image, having been formed on a predetermined photoconductive material, is to be transferred by means of a transferring charger unit movable between an operating position, in which the transferring charger unit presses the continuous-form sheet being fed in a predetermined direction on the predetermined photoconductive material, and a retracting position in which the transferring charger unit is retracted from the operating position, for separating the continuous-form sheet from the predetermined photoconductive material when the transferring charger unit is located at the retracting position: the printer including a sheet separating mechanism comprising a rock member arranged to be supported by a shaft member located above the continuous-form sheet and mounted on the continuous-form sheet. Thus, the continuous-form sheet is downwardly tensioned by weight of the rock member and accurately separated from the photoconductive.

9 Claims, 7 Drawing Sheets

SHEET SEPARATING MECHANISM

BACKGROUND OF THE INVENTION

The present invention relates to a printing device utilizing a continuous-form recording sheet on which a printing operation is to be executed by a so-called electrophotographic system and having a transfer charger retraction mechanism for retracting a transfer charger, used in the electrophotographic system, from an operating position thereof in case that the printing operation is not excuted, more particularly to a printing device capable of definitely separating the continuous-form recording sheet having been pressed to a photoconductive drum by means of the transfer charger from the photoconductive drum with retraction of the transfer charger.

An image forming apparatus, such as a printer, making use of the electrophotographic system, by which a latent image is formed by exposing a photoconductive agent on a surface of a photoconductive drum which is arranged to be rotated to light known. The latent image is developed by adhering toner thereto, the toner is transferred onto a recording sheet arranged to be synchronously fed with the rotation of the photoconductive drum, and finally, the transferred toner is fixed by means of a fixing unit. As the image forming apparatus, there is an electrophotographic printer for printing information on a folding type continuous sheet with feed holes, which is called a fan-folded sheet similar to that used in a conventional line printer and the like.

The fan-folded sheet is arranged in such a manner that a boundary of each of pages thereof is provided with a perforated tear line for cutting, and thus, the fan-folded sheet is alternately folded along the perforated tear line in the opposite direction and applied to the image forming apparatus in a stacked state.

Incidentally, a printer using the continuous-form sheet as a recording medium must begin printing operation at a position of each of the pages spaced from the perforated tear line by a predetermined distance. That is, the printing operation is started at the position spaced from a leading edge in a direction along which the printing operations are executed. In the above arrangement of the electrophotographic system, an exposure unit, a development unit and a transfer unit are disposed around the photoconductive drum and put into operation sequentially as the photoconductive drum is rotated, and thus an image is transferred when the exposed portion of the photoconductive drum gets to a transfer position during the rotation of the photoconductive drum. Therefore, a print start point on the continuous-form sheet must be adjusted by relatively moving, i.e., rotating, the photoconductive drum with respect to the continuous-form sheet. In other words, before the printing operation is executed, it is necessary to control a positional relationship between the image forming start position on the photoconductive drum and the continuous-form sheet in such a manner that the position of the photoconductive drum at which exposure is to be started coincides with the print start position of the page of continuous-form sheet.

If the continuous-form sheet is kept in contact with the photoconductive drum, i.e., in a transfer state, during the above-described position adjusting operation, a problem arises in that the photoconductive agent on the surface of the photoconductive drum is scratched or worn and shortens the life of the photoconductive drum, or the continuous-form sheet is stained with toner remaining on the surface of the photoconductive drum. To cope with this problem, a prior art system retracts the transfer charger from the operating position at which the transfer charger causes the continuous-form sheet to contact to the photoconductive drum, disclosed in, for example, Japanese Patent Provisional Publication HEI 2-103076. In such conventional charger retracting system, the transfer charger is arranged to be retracted with cease of a feeding operation of the continuous-form sheet.

Nevertheless, a problem arises in that even if the transfer charger is retracted from the operating position after completion of the printing operation, the continuous-form sheet, having been synchronously fed with a rotation of the photoconductive drum at a predetermined speed cannot be instantly stopped, and then, the continuous-form sheet is further slightly fed by the inertia therof, and thus the portion of the continuous-form sheet contact with the photoconductive drum is loosened because the continuous-form sheet is fed by a feeding mechanism located at a downstream side of the photoconductive drum. Therefore, even if the transfer charger is retracted, the continuous-form sheet contacts the photoconductive drum, resulting in the continuous-form sheet being stained by the toner when printing is resumed. This problem is more often caused when the folding direction of the perforated tear line projects toward the photoconductive drum side. Further, this problem is more often caused under low-humidity conditions, such as in winter, since the continuous-form sheet and photoconductive drum are apt contact with each other by electrostatic force generated therebetween under such low-humidity conditions.

SUMMARY OF THE INVENTION

It is therefore an object of the invention to provide an improved sheet separating mechanism capable of separating the continuous-form sheet from the photoconductive drum when the transfer charger is retracted from the operating position, and which is further arranged to be retracted from a sheet feeding path when a cover of a printing device is opened.

For this purpose, according to the present invention, a sheet separating mechanism is adapted to be positioned in an electrophotographic printer having an upper cover movable between an open position and a closed position and using a continuous-form sheet on which a visible image, having been formed on a predetermined photoconductive material, is transferred by means of a transferring charger unit movable between an operating position in which the transferring charger unit presses the continuous-form sheet, being fed in a predetermined direction, on the predetermined photoconductive material, and a retracting position in which the transferring charger unit is retracted from the operating position, for separating the continuous-form sheet from the predetermined photoconductive material, when the transferring charger unit is located at the retracted position:

the sheet separating mechanism comprising a rock member arranged to be supported by a shaft member, which is located above the continuous-form sheet and contacting the continuous-form sheet, whereby the continuous-form sheet is downwardly tensioned by weight the of the rock member when the transferring charger unit is located at the retracted position thereof.

DESCRIPTION OF THE ACCOMPANYING DRAWINGS

DESCRIPTION OF THE EMBODIMENTS

Figure 1:
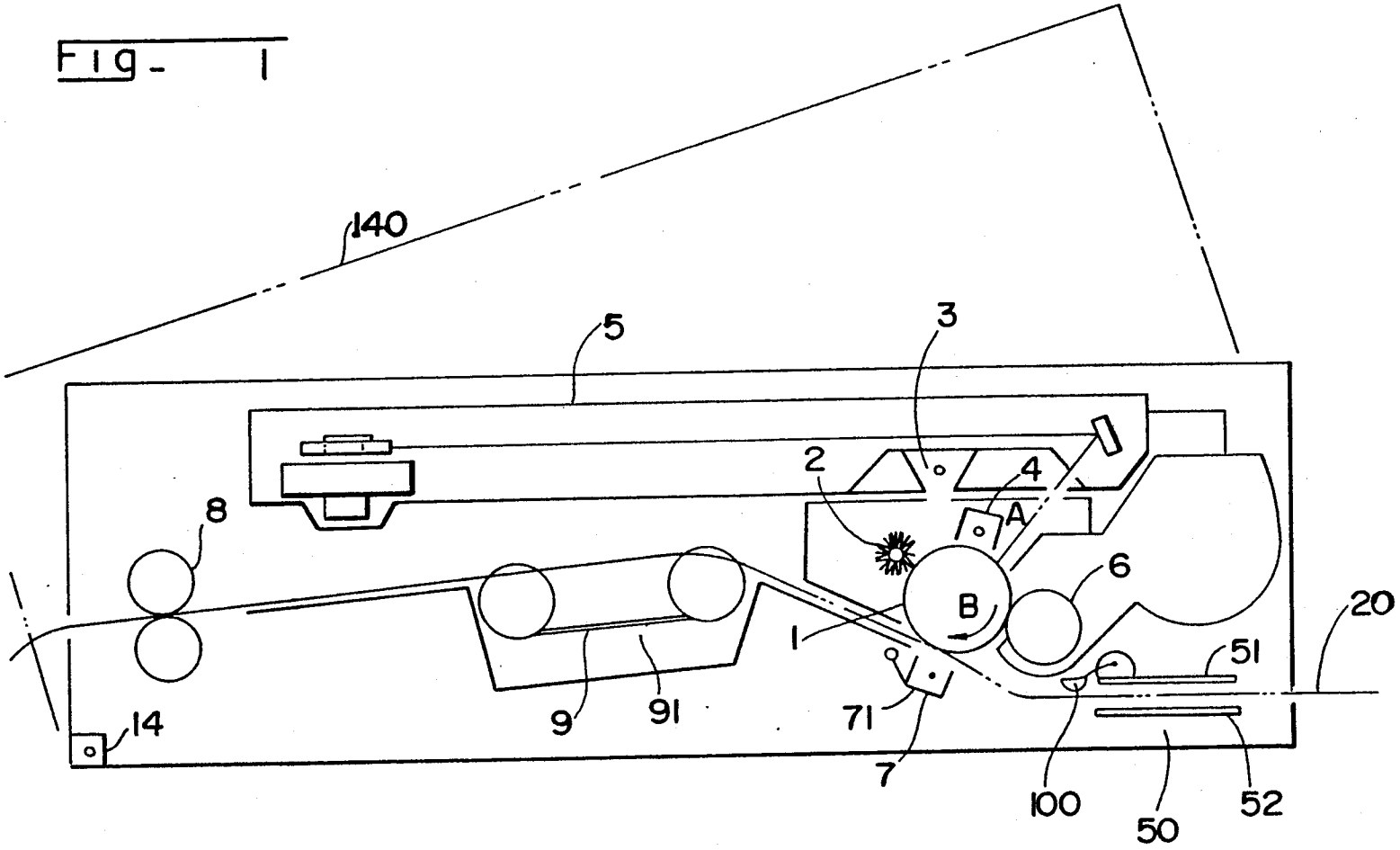
FIG. 1 is a side view showing a schematic arrangement of a printer provided with an embodiment of a recording sheet separation mechanism according to the present invention in which a continuous-form recording sheet is used.

Referring to the drawings, an embodiment of the present invention will be described hereinafter.

FIG. 1 shows a laser beam printing device, using a continuous-form fan-folded sheet as a recording medium, by which character information inputted from a computer or the like is printed on the continuous-form sheet 20 by an electrophotographic system.

A toner cleaning unit 2, a discharging unit 3, a charging unit 4, a scanning optical system 5 for introducing a laser beam to a photoconductive drum 1 as indicated by an arrow "A", a development unit 6, and a transfer unit 7 are disposed, respectively, around the photoconductive drum 1 in the rotating direction thereof indicated by an arrow "B". Further, a fixing unit 8 is disposed at the downstream side of the photoconductive drum 1, and a tractor 9 through which the continuous-form sheet 20 is fed toward the fixing unit 8 is disposed as shown in FIG. 1. The tractor 9 is arranged such that a tractor belt 91, which has projections, not shown, to be engaged with the feed holes of the continuous-form sheet 20 defined at the both side edges thereof, is disposed. On the downstream side of the photoconductive drum 1, a sheet guide mechanism 50, comprising an upper guide plate 51 and a lower guide plate 52, through which the continuous-form sheet 20 is fed is provided. At an outlet side of the sheet guide mechanism 50, a sheet separating mecahnism 100 is provided, Further, the printing device is provided with a clamshell 140 an as upper cover which is rockable between an open position and a closed position around a rocking shaft 14. When the continuous-form sheet 20 is to be set in the printing device, and when maintenance such as a repairing and the like is to be executed, the clamshell 140 is located in the open position as indicated by the two-dot line in FIG. 1.

As the photoconductive drum 1 is rotated in the "B" direction, the surface thereof is charged at the charging unit 4 and scanned by the laser beam from the scanning optical system 5, which has been modulated by an image information to be developed to form an electrostatic latent image. Toner is adhered to the latent image at the development unit 6 to form a visible image corresponding to the latent image. The toner image is transferred onto the continuous-form sheet 20 at the transfer unit 7 and fixed on the continuous-form sheet 20 at the fixing unit 8.

Figure 2:
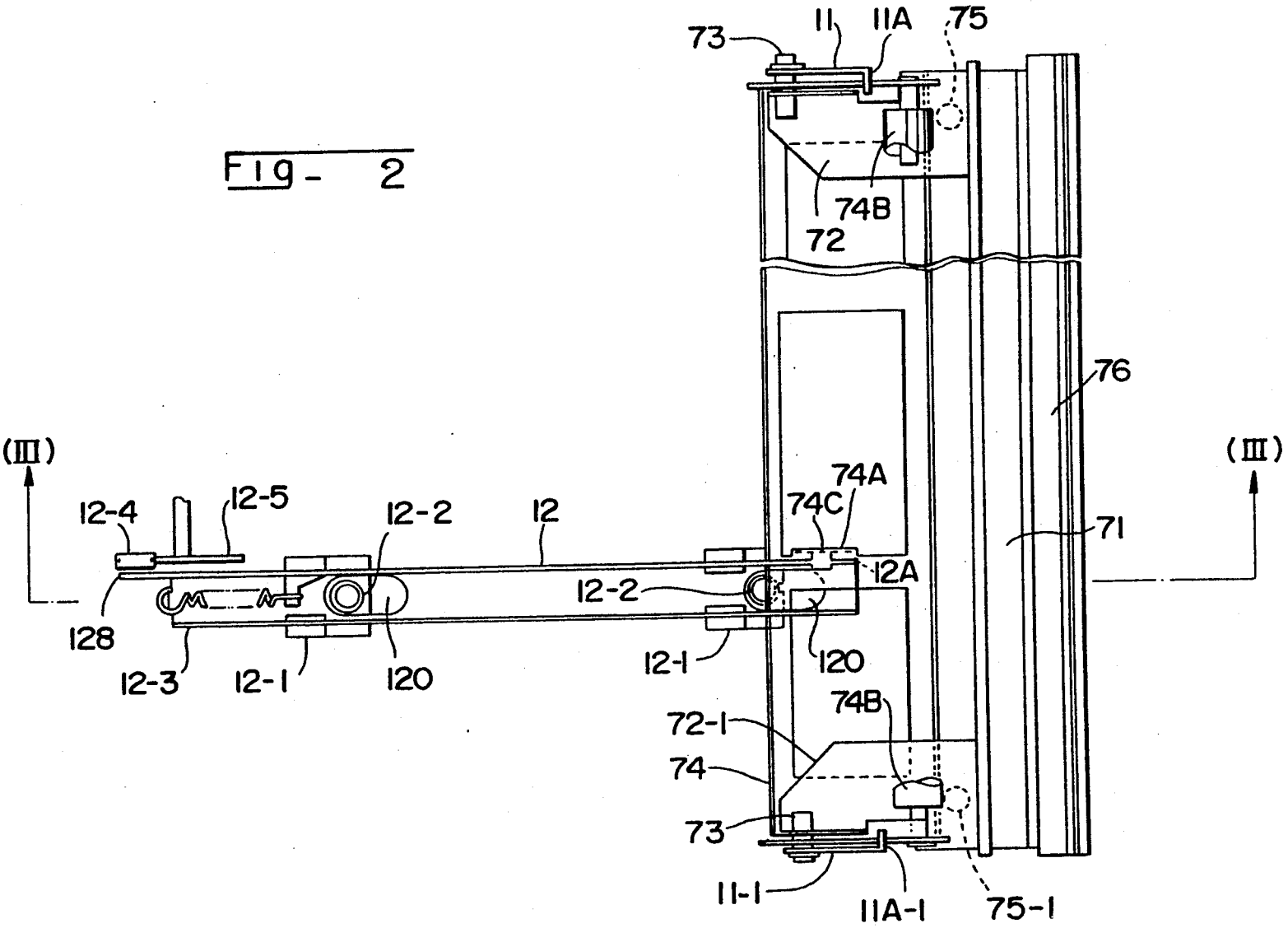
FIG. 2 is a plan view of a transfer unit of the printer shown in FIG. 1.
Figure 3:
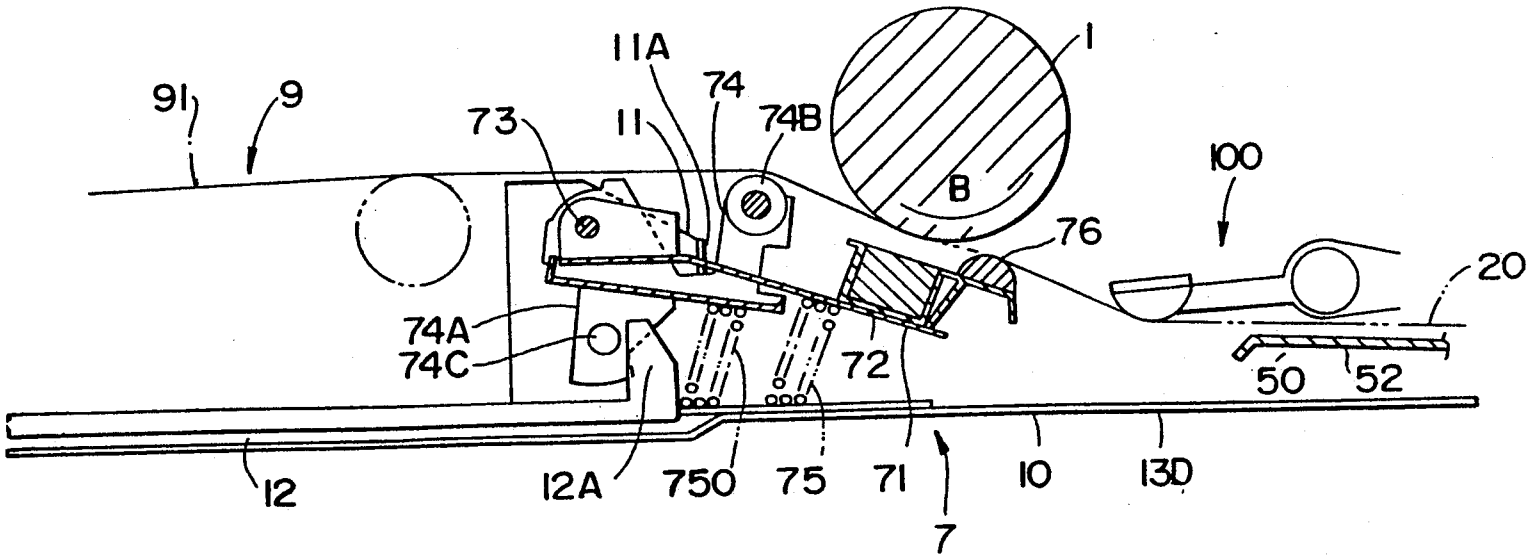
FIG. 3 is a partially enlarged diagram of a transfer unit of the printer shown in FIG. 1 in which a transfer charger is located at an operating position thereof.

FIG. 2 shows a plan view of the transfer unit 7 employed in the printer shown in FIG. 1 and FIG. 3 shows a partial enlarged sectional view taken along the line (III)—(III) of FIG. 2. As shown in FIGS. 2 and 3, the transfer unit 7 is arranged such that a corona electrical charging unit 71 is held at the opposite ends thereof by a pair of arms 72, 72-1 which are rockably supported through a fulcrum 73 by a pair of brackets 11, 11-1, which are both standing on a chassis 10 of the laser beam printer device, so that the corona electric charging unit 71 is in parallel with a rotating shaft of the photoconductive drum 1, and is retractable from the operating position.

In the operating position, the arms 72, 72-1 are upwardly urged by a pair of springs 75, 75-1, which are interposed between the lower surface of the arms and the chassis 10 to enable the corona electric charging unit 71 to be located at a predetermined position at which a transfer operation is carried out by the corona electric charging unit 71. Further, a pressing member 76, having a semi-circular cross section, is located adjacent to the corona electric charging unit 71. When the corona electric charging unit 71 is located at the operating position, the pressing member 76 upwardly presses the continuous-form sheet 20 toward the photoconductive drum 1, so that the transfer operation can be executed on the continuous-form sheet 20.

A sheet presser 74 having a lever 74A downwardly projecting from the lower surface thereof is rockably supported by the fulcrum 73 by which the arms are supported and upwardly biased by another pair of springs 750, 750-1 and stopped by a pair of stopper portions 11A, 11A-1, which are respectively provided in the brackets 11, 11-1. A slide plate 12 is mounted on the chassis 10 of the laser beam printer device in such a manner that it can be slidingly moved along guide plates 12-1, which are respectively fixed to the chassis 10 by means of screws 12-2. A sheet feed roller 74B is provided on the sheet presser and the continuous-form sheet 20 is fed on the sheet feed roller 74B.

On the slide plate 12, a plurality of oval holes 120 are provided, and the slide plate 12 can be slidingly mobved by an amount of length of the oval holes 120. One of ends of a spring 12-3 is connected to one of the guide plates 12-1 and the other end is connected to the slide plate 12, as shown in FIG. 2; further, one of side walls 12B of the guide plate 12 is connected to a cam follower 12-4 which is arranged to be brought into contact with a cam 12-5 having a small diameter portion, and a large diameter portion respectively corresponding to the operating position of the charging unit 71 and a retracted position thereof. When the charging unit 71 is located at the operating position, the small diameter portion of the cam 12-5 is brought into contact with the cam follower. When the transfer charger 7 is to be retracted from the operating position, the cam 12-5 is rotated by means of a not-shown driving source, such as a motor, and the cam follower 12-4 is moved along a sheet feeding direction as the cam 12-5 is rotated, and then, the slide plate 12 is slidingly moved.

When the slide plate 12 is slidingly moved in the sheet feeding direction, the operating portion 12A of the slide plate 12, which is erectly formed at the end thereof, contacts a pin 74C which horizontally projects from a lever portion 74A of the paper presser 74 to cause the sheet presser 74 to be rocked clockwise in the drawing of FIG. 3, so that, the sheet presser 74 downwardly pushes the arms 72, 72-1 against the urging force of the spring 75, 75-1 and thus the corona electric charging unit 71 is downwardly retracted from the operating position.

Referring to the drawings of FIGS. 4 and 5, one embodiment of a sheet separating mechanism 100 will be described hereinafter.

Figure 5:
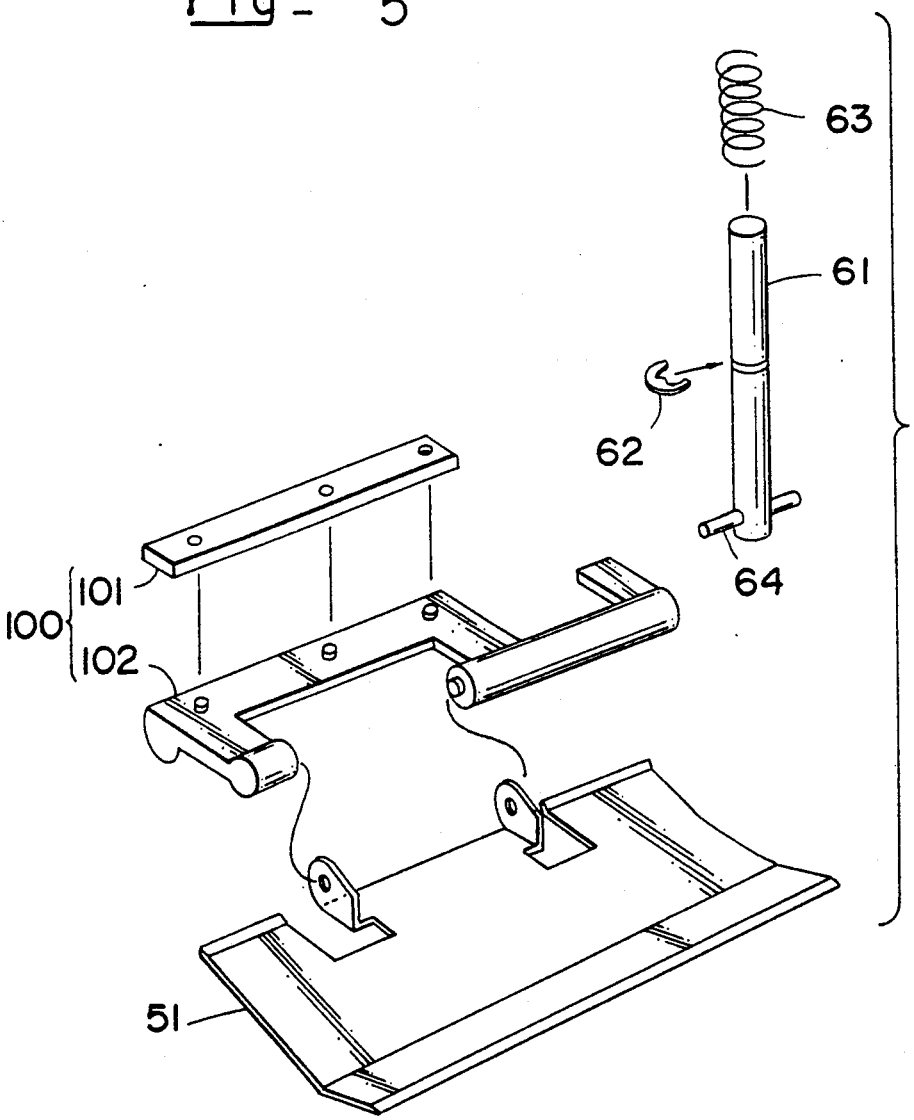
FIG. 5 is an exploded view of the sheet separating mechanism shown in FIG. 4.

As shown in FIG. 5 the sheet separating mechanism 100 comprises a rockable tension member 102 formed by a resin such as plastic and a metal weight 101 arranged to be mounted on the tension member 102. The metal weight 101 is fixed to the tension member 102 in a predetermined manner, such as hot stamping or the like.

Figure 4:
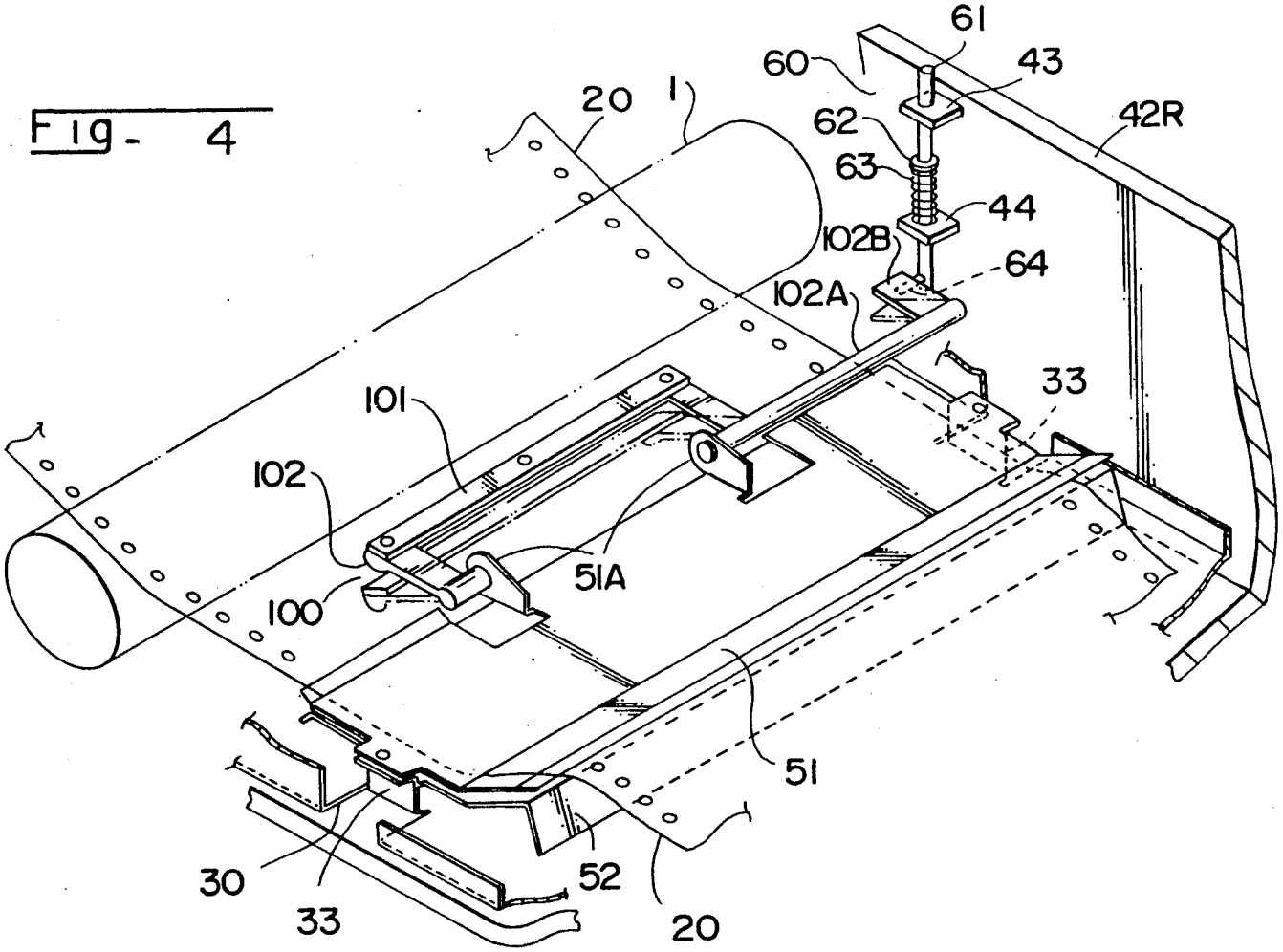
FIG. 4 is a perspective view of one embodiment of the sheet separating mechanism according to the present invention.

As shown in FIG. 4, the upper guide plate 31 and the lower guide plate 52 are fixed to a pair of plate support portions 33 which upwardly project from the chassis 10. A pair of support portions 51A are formed on the upper guide plate 51 and the tension member 102 on which the metal weight 101 is mounted is attached therero in such a manner that the tension member 102 is vertically rocked about the pair of support portions 51A. In this above-described arrangement, tension member 102 is downwardly rocked and located within a feeding path of the continuous-form sheet 20, weight of the metal weight 101 and the tension member 102 is applied to the continuous-form sheet 20. Accordingly, when the corona electrical charging unit 71 is located at the operating position thereof, tension force is downwardly applied to a surface of the continuous-from sheet 20. However, since the continuous-form sheet 20 is supported by means of the pressing member 78, the continuous-form sheet 20 is not downwardly moved. On the contrary, when the corona electrical charging unit 71 is located at the retracted position thereof. The tension force causes the continuous-form sheet 20 to be downwardly moved since the continuous-form sheet 20 is not supported by means of the pressing member 78. Accordingly, the continuous-form sheet 20 is caused to downwardly move when the charging unit 71 is located at the retracted position, and definitely separated from the photoconductive drum 1.

Further, in this embodiment, the tension member 102, mounting the metal weight 101, is arranged so as not to be located in a sheet feeding path along which the continuous-form sheet 20 is fed. Since the tension member 102 is arranged to be downwardly rocked, it crosses the sheet feeding path when the continuous-form sheet 20 is not set in the printing device. When a continuous-form sheet 20 is newly set into the printing device, it is necessary to upwardly rock the tension member 102. It may be considered that the tension member 102 is automatically rocked upwardly when the continuous-form sheet 20 is newly set. For this purpose, in this embodiment, a linkage mechanism 80 for upwardly rocking the tension member 102 when the clamshell 140 is opened.

In the printing device, a side frame 42R is provided on the right-hand side of the sheet feeding direction as shown in FIG. 4, and a pair of guide projecting 43, 44 are integrally formed in the vertical direction. On the projections 43, 44, through holes are formed, and a push rod 61 is inserted within the through holes in such a manner that the push rod 61 is vertically slidable. Further, a spring 63 is wound around the push rod 61 and located between the projections 43, 44 and one end thereof is fixed by means of E-type retaining ring 62, and a contact pin 64 which horizontally projects on the lower side of the push rod 61 as shown in FIG. 5. The push rod 61 is arranged to be downwardly pushed by means of a pushing member, such as a rod, not shown, integrally formed with an inner surface of the clamshell 140. In other words, the push rod 61 is downwardly pushed when the clamshell 140 is closed, while it is not downwardly pushed and upwardly moved by elastic force of the spring 63 when the clamshell 140 is opened. On the other hand, an arm 102A of the tension member 102 extends toward the side frame 42R and an operating plate 102B, whose lower surface is arranged to be located over the contact pin 64, is formed at the end portion thereof.

In this above-described arrangement of the linkage mechanism 60, when the clamshell 140 is closed, the push rod 140 is downwardly pushed, and accordingly, the tension member 102 mounting the metal weight 101 is downwardly rocked by its own weight and applies the tension force to the surface of the continuous-form sheet 20. On the contrary, when the clamshell 140 is opened, the push rod 61 is upwardly moved by means of the spring 63, and accordingly, the contact pin 64 pushes the operating plate 102B, and the tension member 102 is upwardly rocked. In other words, the tension member is retracted form the sheet feeding path when the clamshell is opened. Accordingly, an operator can easily set the new continuous-form sheet 20 without distrubance by means of the tension member 102. In this embodiment, the side frame 42R is provided for supporting the linkage mechanism 60, however, it may be considered that the linkage mechanism 60 is provided on an inner surface of a case member of the printing device and the push rod 61 is pushed by means of the clamshell itself.

Figure 6:
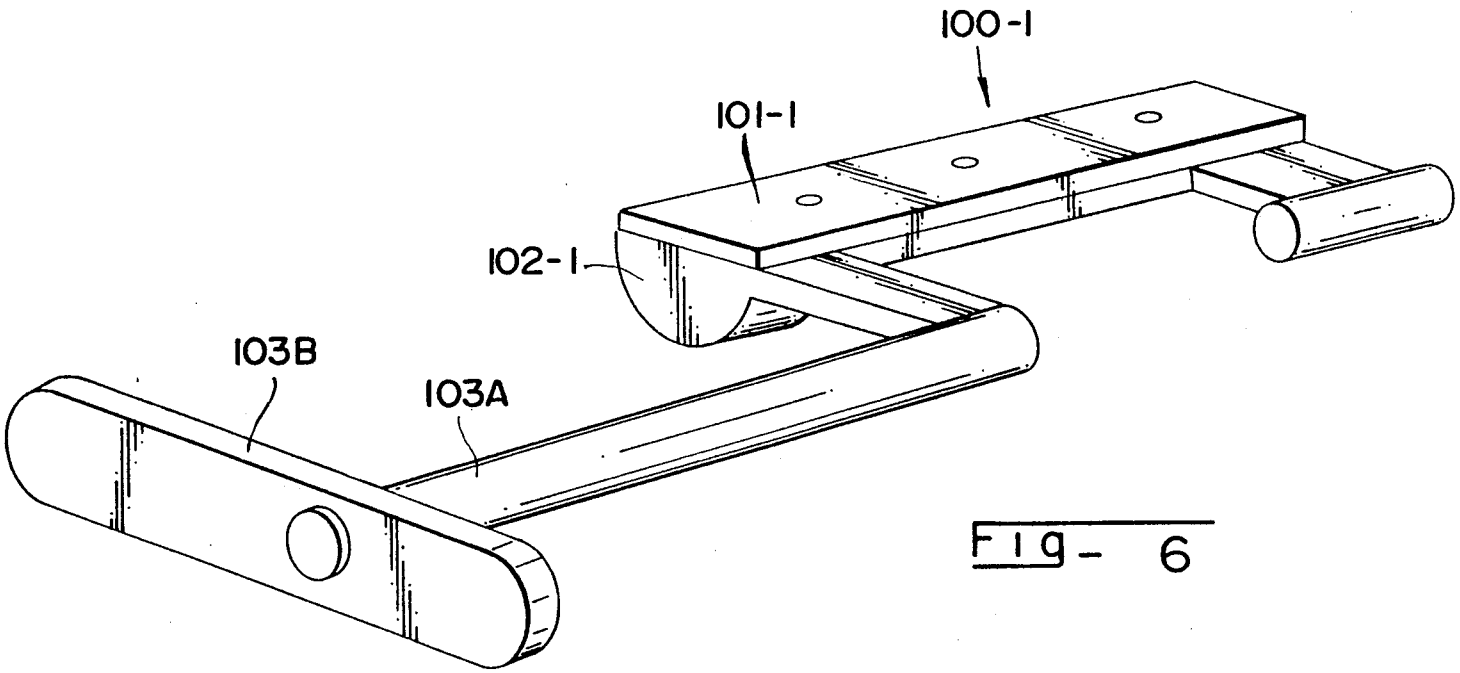
FIG. 6 is an enlarged view of a tension arm employed in another embodiment of the sheet separating mechanism according to the present invention.
Figure 7:
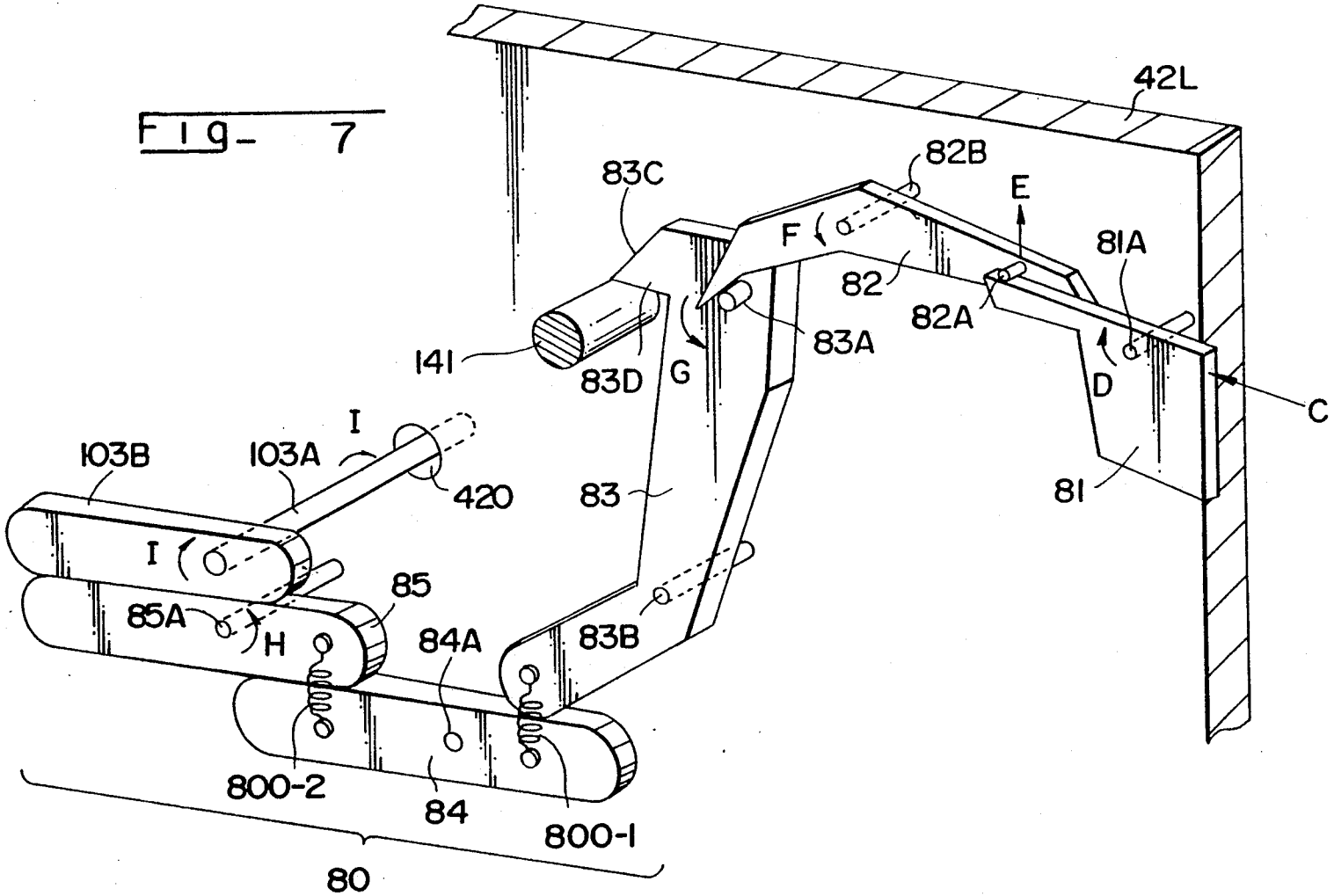
FIG. 7 is a perspective view of another embodiment of the sheet separating mechanism according to the present invention employing the tension arm shown in FIG. 6.

Referring to drawings of FIGS. 6 and 7, another embodiment of the sheet separating mechanism utilizing another linkage mechanism 80.

In this embodiment, a lock lever 83, for locking the clamshell 41, so as not to be undesirably moved when closed, is utilized. On the left-hand side of the sheet feeding direction, a side frame 42L, for supporting the lock lever 83 which is arranged to be rocked about a shaft 83B.

On an inner surface of the clamshell 140, a lock pin 141 is provided. When the clamshell 140 is closed, the lock pin 141 is moved along an inclined surface 83C of the lock lever 83, pushing rightwardly in the drawing. When the clamshell is completely closed, the lock pin 141 is contacted with a contact portion 83D of the lock lever 83, and the clamshell 140 is locked so as not to be undesirably opened.

On an outer surface of the printing device, a release button, not shown, is provided for releasing a locking operation of the lock lever 83. When the release button is operated, a pushing force is applied to the release piece 81 by means of a, not shown, member such as a rod as indicated by an arrow "C". The releasing piece 81 is arranged to be rocked about a shaft 81A, in advance, and rocked in clockwise direction as indicated by an arrow "D". A contact piece 82 is rockably provided on the side freame 42L about a shaft 82B and a pin 82A arranged contact an upper surface of the releasing piece 81 which projects from the contact piece 82. When releasing piecer 81 is rocked, the contact pin 82A is pushed upwardly as indicated by an arrow "E" and the contact piece 82 is rocked in counterclockwise direction as indicated by an arrow "F". When the contact piece 82 is rocked, a pin 83A provided on a surface of the lock lever 83 is pushed and the lock lever 83 is rocked as indicated by an arrow "G". In other words, when the release button is operated, engagement between the contact portion 83D and the contact pin 141 is released, and it becomes possible to open the clamshell 140.

The lock lever 83 is further connected to an first arm 84 arranged to be rocked about a shaft 84A through a spring 800-1, and the first arm 84 is connected to a second arm 85 by another spring 800-2. The second arm 85 is arranged to be rocked about a shaft 85A which is provided on the side frame 42L. When the clamshell 140 opened, the lock pin 141 is further pushes the inclined surface 83C of the lock lever 83 and the first arm 84 pulls the second arm 85 downwardly, and the second arm is rocked in clockwise direction a indicated by an arrow "H".

In the meantime, on the continuous-form sheet 20, a separating mechanism 100-1, comprising a metal weight 101-1 and a tension member 102-1, shown in FIG. 6, is similarly located as in the previous embodiment. In this tension member 102-1, a shaft 103A extends toward the leftward direction. On the second arm 85, as shown in FIG. 7, a moving arm 103B which is connected to the arm 103A is mounted.

When the lock lever 83 is rocked and the second arm 85 is rocked, the moving arm 103B is rocked clockwise as indicated by an arrow "I". Accordingly, the tension member 102-1 is upwardly rocked instantaneously when the clamshell 140 is opened. The operator can support the tension member 101-1 in such a manner that it is retracted from the sheet feeding path. Accordingly, it becomes possible to set the continuous-form sheet in the printing device.

As described above, the sheet separating mechanism according to the present invention is arranged to definitely separate the continuous-form sheet from the photoconductive drum when the printing operation is not executed, further, to be retracted from the sheet feeding path when the continuous-form sheet is newly set. Accordingly, the continuous-form sheet can be set without disturbance of the sheet separating mechanism located in the sheet feeding path.

The present disclosure relates to subject matter contained in Japanese patent application No. HEI 02-030682 (filled on Feb. 9, 1990) and the Japanese patent application No. HEI 03-98342 (filed on Jan. 31, 1991) which are expressly incorporated herein by reference in their entireties.

What is claimed is:

1. A sheet separating mechanism, adapted to be positioned in an electrophotographic printer using a continuous-form sheet on which a visible image, having been formed on a predetermined photoconductice material, is to be transferred by means of a transferring charger unit movable between an operating position, in which said transferring charger unit presses the continuous-form sheet being fed in a predetermined direction on said predetermined photoconductive material, and a retracting position, in which said transferring charger unit is retracted from said operating position, for separating the continuous-form sheet from said predetermined photoconductive material in case that said transferring charger unit is located at said retracting position;

said sheet separating mechanism comprising a rockable tension member arranged to be supported by a shaft member, said rockable tension member being located above the continuous-form sheet and contacting the continuous-form sheet, said shaft member extending in a direction perpendicular to the feeding direction of said continuous-form sheet, whereby said continuous-form sheet is downwardly tensioned by weight of said rockable tension member when said transferring charger unit is located at said retracting position thereof.

2. The sheet separating mechanism according to claim 1, which further comprises an upper cover movable between an opening position and a closing position, and a rocking mechanism for rocking said rockable tension member upwardly when said upper cover is located at said opening position.

3. The sheet separating mechanism according to claim 1, wherein said rockable tension member comprises a metal weight and an arm member made from resin for mounting said metal weight.

4. The sheet separating mechanism according to claim 2, wherein said rocking mechanism comprises a pair of contact portions integrally formed with said rockable tension member, and a linkage mechanism arranged so as to rock upwardly a contact portion when said upper cover is located at said opening position.

5. The sheet separating mechanism according to claim 4, wherein said linkage mechanism comprises a push rod member arranged so as to be pushed downwardly against biasing force applied from a predetermined biasing member when said upper cover is located at said closing position, a predetermined portion of said push rod member being arranged so as to be contacted with a lower surface of said contact portion, whereby said rockable tension member with said contact portion is rocked upwardly by means of said predetermined portion of said push rod member when said upper cover is located at said opening position.

6. The sheet separating mechanism according to claim 5, wherein said predetermined biasing member comprises a spring wound around said push rod member.

7. The sheet separating mechanism according to claim 4, wherein said linkage mechanism comprises a rocking arm arranged so as to rock said contact portion of said rockable tension member when a lock lever provided on said upper cover is released.

8. A sheet separating mechanism, adapted to be positioned in an electrophotographic printer having an upper cover movable between an opening position and a closing position, and using a continuous-form sheet on which a visible image, having been formed on a predetermined photoconductive material, is to be transferred by means of a transferring charger unit movable between an operating position, in which said transferring charge unit presses the continuous-form sheet being fed in a predetermined direction on said predetermined photoconductive material, and a retracting position, in which said transferring charger unit is retracted from said operating position, for separating the continuous-form sheet from said predetermined photoconductive material when said transferring charger unit is located at said retracting position;

said sheet separating mechanism comprising a rockable tension member arranged so as to be supported by a shaft member, said rockable tension member being located above the continuous-form sheet and contacting the continuous-form sheet, and arranged so as to be upwardly rocked in case that said upper cover is located at said opening position.

9. A sheet separating mechanism, adapted to be positioned in a device employing a continuous-form sheet adapted to be fed, for separating said continuous-form sheet from a predetermined part in said device to which said continuous-form is to be pressed by means of a predetermined movable member, only when a feeding operation of said continuous-form sheet is executed;

said sheet separating mechanism comprising a rockable tension member including a weight aranged so as to be supported by a shaft member, said rockable tension member being located above the continuous-form sheet and contacting the continuous-form sheet.

* * * * *

UNITED STATES PATENT AND TRADEMARK OFFICE

CERTIFICATE OF CORRECTION

PATENT NO. : 5.113,228

DATED : May 12, 1992

INVENTOR(S) : Y. MONMA et al.

It is certified that error appears in the above-indentified patent and that said Letters Patent is hereby corrected as shown below:

On the cover sheet, in section [75], "Inventors", line 1, change "Oodi" to ---Iruma --.

At column 7, line 57 (claim 1, line 4) change "photoconductice" to ---photoconductive---.

At column 8, line 57 (claim 8, line 9) change "charge" to ---charger---.

At column 10, line 4 (claim 9, line 9) change "aranged" to ---arranged---.

Signed and Sealed this

Fifth Day of September, 1995

Bruce Lehman

*Attest:*

BRUCE LEHMAN

*Attesting Officer*

*Commissioner of Patents and Trademarks*